US005497579A

United States Patent [19]

Walters

[11] Patent Number: 5,497,579

[45] Date of Patent: Mar. 12, 1996

[54] MECHANICAL LINKAGE SASH DISPLACEMENT DEVICE

[75] Inventor: Nicholas Walters, Baltimore, Md.

[73] Assignee: Easy Up Sash Lift, Inc., Baltimore, Md.

[21] Appl. No.: 304,682

[22] Filed: Sep. 12, 1994

[51] Int. Cl.[6] ..... E05B 1/00

[52] U.S. Cl. ..... 49/460

[58] Field of Search ..... 49/404, 405, 460, 49/461, 363, 360; 16/111 R, 112, 124, 125, 126

[56] References Cited

U.S. PATENT DOCUMENTS

| | | | |
|---|---|---|---|
| 965,096 | 7/1910 | Fisher | 49/461 |
| 1,164,340 | 12/1915 | Faulhaber | 49/363 X |
| 4,516,355 | 5/1985 | Basil | 49/460 |

*Primary Examiner*—Kenneth J. Dorner
*Assistant Examiner*—Jerry Redman
*Attorney, Agent, or Firm*—Peter Gibson

[57] ABSTRACT

A sash is displaced manually by the exertion of force upon a frontal bar rigidly connected to the distal ends of a first pair of arms spaced apart from each other extending perpendicularly from opposed jambs pivoted at proximate ends. A second pair of arms, similarly spaced apart from each other, is pivoted to the sash at proximate ends above the first arm pivots to the jambs, the distal ends being pivoted to the first arms at a point medial the first arm ends. The length of each arm and the distance between congruent connections is equivalent and all six pivots enable rotation in planes perpendicular to the sash. The frontal bar, the first arms and the two pivots connecting congruent pairs of arms are displaced in an arc with respect to the sash and jambs and linear displacement of the sash by this linkage is effected with a basic mechanical advantage equal to the length of the first arm divided by the radius of the arc described by the either pivot between paired arms. The linear travel of the sash is related to the arcuate displacement of the frontal bar by the tangent of the second arm taken to the pivot arc which varies continuously. The total travel equals twice the pivot arc radius. The rate of sash travel as a function of arcuate displacement, the precise inverse of the overall mechanical advantage, is greatest when the pivot between arms is in the portion of the arc above perpendicular to the face of the closure. Conversely, the rate of travel is least and the mechanical advantage is greatest in the pivot arc lower portion proximate the jambs. The mechanical advantage provided by this linkage thus varies to provide the most advantage when it is most needed, initially from the closed position, and provides the greatest rate of sash travel where manual effort is most easily exerted. This linkage also provides automatic exterior locking of the sash in the closed position. Reach over a frontal barrier is also facilitated with an optional auxiliary bar offset from and parallel to the frontal bar and more further mechanical advantage is obtainable with an auxiliary arm connected by ratchet to one of the first arms.

18 Claims, 3 Drawing Sheets

MECHANICAL LINKAGE SASH DISPLACEMENT DEVICE

BACKGROUND OF THE INVENTION

1. Field of the Invention

The general field of the present invention is that of slidable reciprocating closure devices, more particularly slidable multi-sashed closures between opposed jambs within a fully bounded frame, specifically devices assisting in displacement of such sashes within such frames.

2. General Background

Devices assisting in the ease of operating vertically hung sash windows have historically involved a mechanism using a sash cord or chain connected to a sash and run over a pulley to a sash weight inside the window frame exterior the jambs wherein the weight acts as a counter balance to the sash. More recently, spring loaded mechanisms which release energy assisting displacement of the window in opening and which store energy and thus retard displacement in closing have gained prevalence in the current market for residential construction in the United States.

Many people lacking strength or mobility in the upper body have difficulty in operating such windows. This problem is exacerbated by any barrier disposed in front of the closure which prevents the placing of one's person immediately proximate the frame of the closure as in the case of a window disposed behind and above a kitchen sink, for example. In consequence of such location a person desiring to displace the window must extend their arms a substantial distance and cannot exert more than a small fraction of the strength available in a proximate situation upon this distally located window in order to operate the same.

DISCUSSION OF THE PRIOR ART

The specific problem set forth immediately above has received direct attention by the prior art. The present inventor and author concur that U.S. Pat. No. 4,516,355 issued May 14, 1985 to Dan Basil is considered to be the disclosure most pertinent to the present invention known to said inventor and author. Aspects of this disclosure include objects of the present invention. The structure of Basil's disclosure is simply that of two parallel "lift guides" attached to the opposed vertical sash members of the lower sash of a double hung sash window acting as auxiliary guides along the vertically disposed jambs in conjunction with a U shaped bar comprising "lift arms" extended horizontally from the lower sash outward, presenting a parallel bar portion medial to the arms spaced apart from and rigidly connected to the lower sash.

This cantilevered bar reduces the reach over a barrier required to operate a window and enables the exertion of force upon a fulcrum rigidly fixed to the lower sash member, causing a moment about the juncture of the lift arms with the sash which promotes binding of the sash within the jambs. Because the lever is fixed no mechanical advantage can be obtained in regard to displacement of the sash, which condition is evidenced by the simple observation that the sash is displaced an amount equal to the displacement of the "lift arms".

Other references pertaining to assistance in the operation of multiple sash closures, such U.S. Pat. No. 820,231 issued to Merryweather for a 'Handle Attachment for Window Sashes', and U.S. Pat. No. 610,135 issued to Green for a 'Sash Lift', or U.S. Pat. No. 1,620,817 issued to Huyard for a 'Window Sash Attachment' are further mentioned as devices which do not provide any genuine mechanical advantage in operation but assist in displacement by providing an auxiliary purchase or reaction point for the exertion of force upon the sash. The Basil disclosure is the only disclosure known teaching the use of a frontal bar portion parallel and offset from the face of the closure operable upon a sash. No disclosure of a mechanical linkage utilized to displace a sash within a bounded frame is known in the prior art.

The usage of mechanical linkage to obtain mechanical advantage in the operation of a reciprocating closure considered closest to the present invention is a device commonly used to operate furnace doors, such as that disclosed in U.S. Pat. No. 1,539,170 issued to Eddison. In this and other known uses of mechanical linkage to operate a reciprocating closure the frame is not fully bounded and the linkage is connected with the door through an open edge of the frame, essentially within the plane of the door and is operated from the side of the door. This is in marked contrast to a double hung sash window or horizontally sliding glass door which is also a commonplace in current residential construction wherein the closure must seal the area within a fully bounded frame and manual operation must necessarily be from in front of the closure.

STATEMENT OF NEED

It is therefore considered that a need exists for a device which will assist in manual operation of multi-sashed, fully bounded reciprocating closures by providing a mechanical advantage with regard to displacement of such a sash and which will further facilitate operation from a distance in front of the closure.

SUMMARY OF THE INVENTION

The object of the present invention is a device utilizing mechanical linkage which, properly installed, will provide mechanical advantage in manual operation of a multi-sashed, fully bounded closure and which will further facilitate operation from a distance in front of said closure.

A pair of first arms each rigidly attached at the distal end to a bar frontally disposed parallel to the closure is considered. Each first arm is pivoted at the proximate end to a jamb and the distal end of a second arm is pivoted to each first arm at a position medial to both said ends of the first arm. The proximate end of each second arm is pivoted to one sash. The effective lengths of congruent distances between pivots of the two pairs of linked first and second arms and connection to the frontal bar are substantially equivalent and the pivots enable rotation of each arm in substantially parallel planes substantially perpendicular to the face of the closure.

The linkage thus described is intended to be installed in front of an interior face of a fully bounded, multiple-sashed closure. Mechanical advantage in operation of one sash is thereby provided equivalent to the effective length of each first arm divided by the distance between the pivot of the first arm to the jamb and the pivot connecting the first and second arms together. Linear displacement of the sash with respect to the jambs as effected by the arcuate displacement of the frontal bar is dependent upon the tangent of the second arm with respect to the arc described by the pivot between arms. This tangent is greatest and the corresponding rate of sash displacement is greatest when the pivot between the arms is in the portion of the arc proximate the pivoted connection of the second arm to the sash.

An automatic locking feature of the sash properly connected to the linkage described is provided in the closed position with the frontal bar proximate the face of the closure. The frontal bar is adjustable in effective length to correspond with varying closure width; the preferred embodiment herein utilizing telescoping bar elements, along with an outer sleeve cut to length to provide a uniform appearance. The effective length of the pivot arc radius as a fraction of the total first arm length is further adjustable and both the sash travel available and the basic mechanical advantage provided by the device are inversely variable in accordance with the relative length of the pivot arc radius with the first arm effective length.

Additional means of further facilitating reach of the device over a barrier disposed in front of and below the closure is provided with an auxiliary frontal bar rigidly disposed parallel to and spaced apart from the frontal bar. Also, extension of the first arms by a ratchet connection further provides additional mechanical advantage if desired and the auxiliary frontal bar can be connected by auxiliary arms connected by a ratchet.

DETAILED DESCRIPTION OF THE INVENTION

Figure 1:
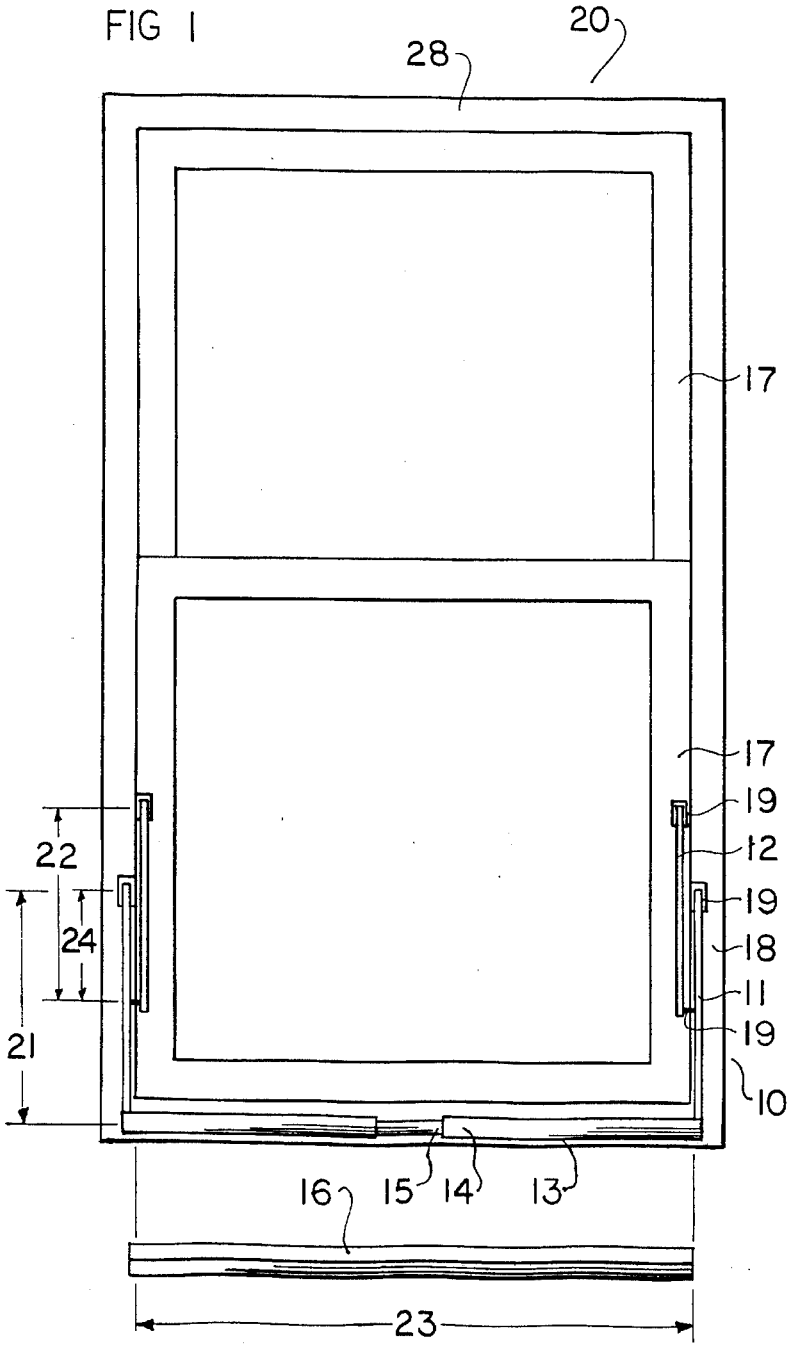
FIG. 1 is a plain elevational view taken from the front of a preferred embodiment of the principles relating to the present invention in the closed position further illustrating telescopic construction of the frontal bar to allow length adjustment.
Figure 3:
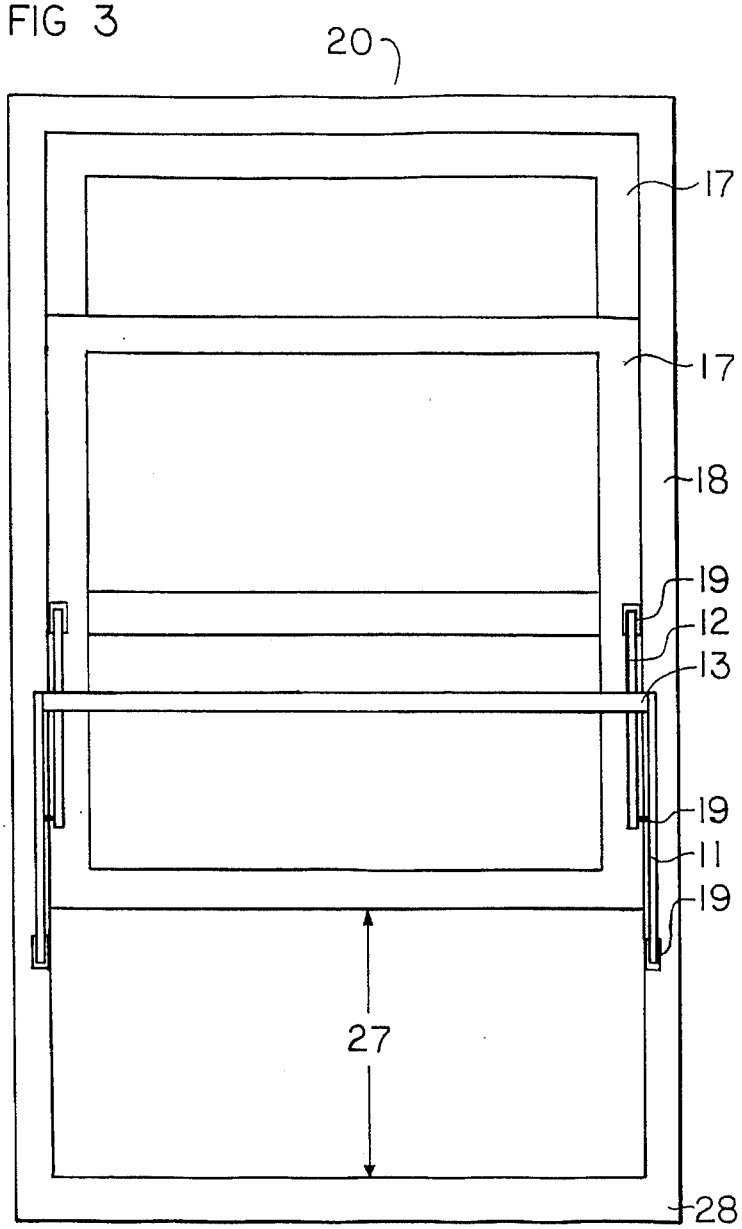
FIG. 3 is a plain elevational view taken from the front of a preferred embodiment of the principles relating to the present invention in an open position illustrating the maximum sash travel available.

With reference to FIGS. 1 & 3 wherein a preferred embodiment of the principles relating to the present invention is depicted one may discern a displacement device 10 comprised of a pair of first arms 11, a pair of second arms 12, a frontal bar 13 which, in this preferred embodiment, is further comprised of two lateral elements 14, a medial element 15 and a slit tube sleeve 16, and connections between the two arms and of each arm to either the sash 17 or a jamb 18 by means of a pivot 19. As clearly seen in FIG. 1, each first arm 11 possesses an effective first arm length 21 equal to the distance between the pivot 19 connecting the proximate end of the first arm 11 to the jamb 18 and the connection of the distal end of the first arm 11 to the frontal bar 13. The second arm 12 similarly possesses an effective second arm length 22 equal to the distance between the pivot 19 connecting the proximate end of the second arm 12 to the sash 17 and the pivot connecting the distal end to the first arm 11.

The position of the pivot 19 between arms is redial to the ends of the first arm 11 and is adjustable, as indicated by the three in line pivot 19 positions depicted in FIG. 1. The position of this pivot determines both the available total available sash travel 27, depicted in FIG. 3, and the basic mechanical advantage available. The total sash travel 27 available is simply equal to twice the pivot arc radius 24 depicted in FIG. 4 which is the distance between the pivot 19 connecting the first arm 11 with the jamb 18 and the position of the pivot 19 between the arms. Since the effective length 21 of the first arm 11 is fixed, and the pivot 19 between the arms is adjustable along the medial portion of the first arm 11, the pivot arc radius 24 is adjustable as a greater or lesser proportion of the effective first arm length 21 which length divided by the pivot arc radius 24 yields the basic mechanical advantage of the displacement device 10. It is further noted that this mechanical advantage and the travel 27 permitted are inversely related; the greater the pivot radius 24, the greater the sash travel 27 enabled and the less mechanical advantage derived.

Figure 4:
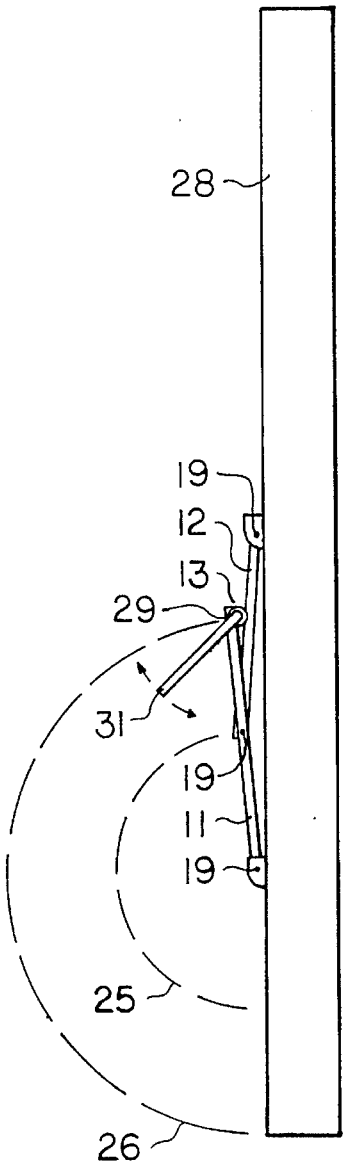
FIG. 4 is a plain elevational view taken from the side of an alternative embodiment of the principles relating to the present invention illustrating an auxiliary first arm connected by a ratchet, the arc described by the first arm and the arc described by the pivot radius.
Figure 5:
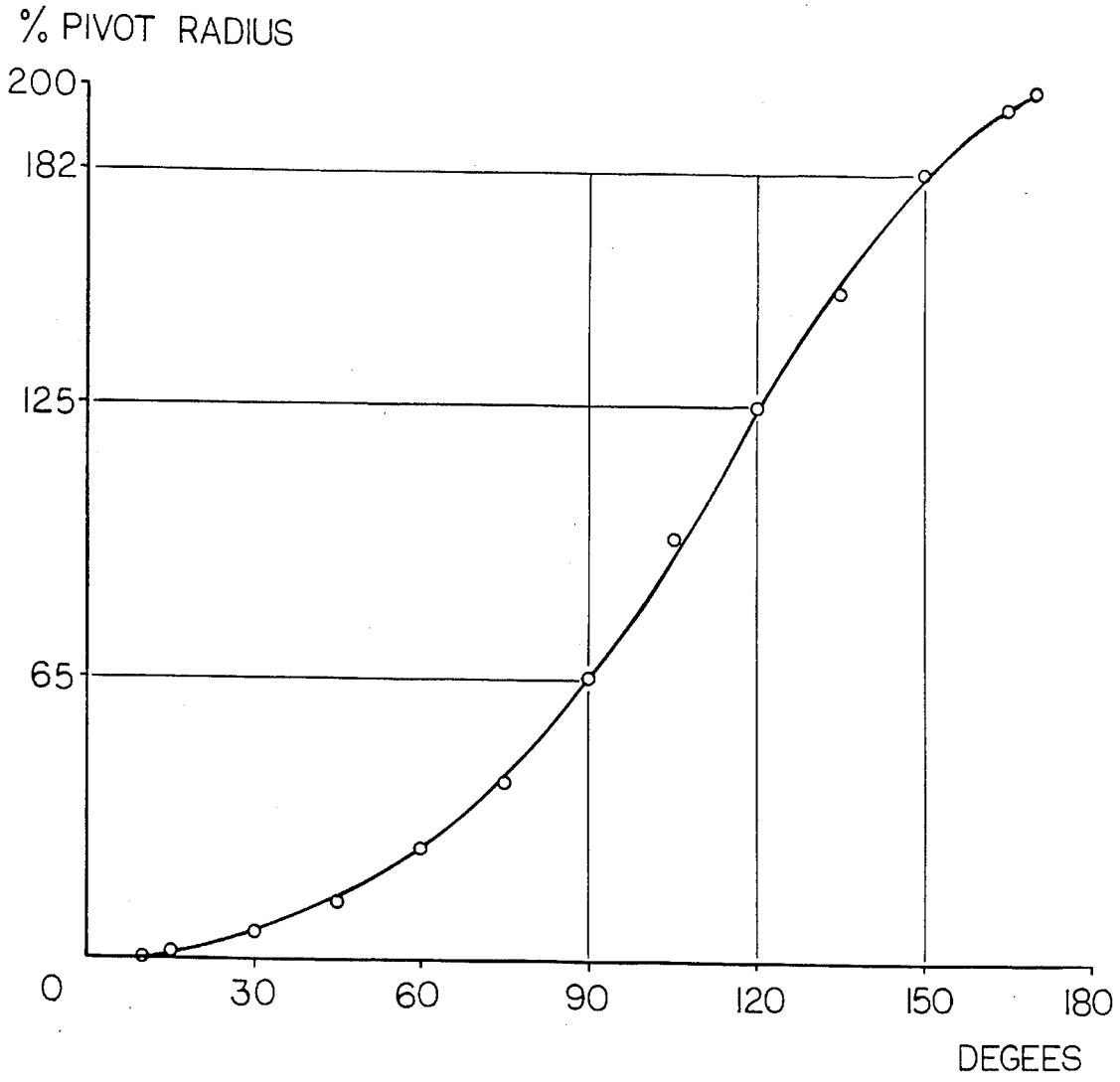
FIG. 5 is a graphical representation of sash linear displacement as a function of pivot arcuate displacement.

The pivot arc 25 displacement, a proportion of the first arm arc 26 displacement, effects the displacement of the sash, ie. sash travel 27, through a linkage with the second arm 12 that depends upon the relation of the tangent of the axis of the second arm 12 with respect to the pivot arc 25 depicted in FIG. 4. A graphical representation of this relation is depicted in FIG. 5 wherein the point of greatest tangent value, one, is seen to be the point of inflection of the curve illustrated therein. While numerical values for dimensions are of no special significance, the relation between certain effective distances is essential to the principles relating to the present invention. As aforementioned, the maximum sash travel 27 permitted is twice the pivot arc radius 24, and the basic mechanical advantage derived is given by the effective first arm length 21 divided by the pivot radius 24. The total effective mechanical advantage is not so simply obtained, however, as it is inversely dependent upon the relation of the tangent of the axis of the second arm 12 with respect to the pivot arc 25.

This relation may be described by an integral possessing the basic mechanical advantage as a constant taken over the available range of arcuate displacement for the tangent of the axis of the second arm 12 with respect to the pivot arc 25 which is continuously variable and therefore presents a rather difficult mathematical model. Alternatively, reference may be made to FIG. 5 wherein the linear displacement of the sash 17 herein known as the sash travel 27 is shown as a function of displacement through the pivot arc 25, expressed in percentage of the effective pivot radius 24 as a function of degrees from closed for an embodiment of the principles relating to the present invention possessing a basic mechanical advantage of 2.305.

Omitting the extreme ten degrees, (10°), on either side physically unavailable for arcuate displacement, combined with an effective first arm length 21 of 2.34 pivot radii 25, the first arm arcuate displacement may be readily calculated to be $(160°/180°)(\pi)(r)=0.88900(\pi)(2.34 \text{ pivot radius } 25)=6.53$ pivot radii 25. Compared with the total linear sash displacement 27 effected thereby, 2.00 pivot radii 25, one readily finds an overall mechanical advantage of 6.53/2.00=3.27 which is an average value for an effective mechanical advantage which varies widely in a complex relation most readily understood as the inverse of the slope of the complex curve depicted in FIG. 5. It is apparent from this curve that the greatest mechanical advantage is derived when the frontal arm 13 is proximate the face of the closure 20, as in the closed position depicted in FIG. 1 & 2, and is least wherein the position of the second arm 12 is perpendicular to the first arm 11 and the tangent between the axis of the second arm 12 with respect to the pivot arc 25 is maximum which is also the inflection point in the curve seen in FIG. 5.

It is further seen in the graphical representation depicted in FIG. 5 that the rate of linear sash displacement 27, (the slope of the curve), does not become great until approximately 90°, when the first arm 11 is perpendicular to the face of the closure 20 and the frontal bar 13 is extended furthest from the face of the closure 20 and is in the position that best accommodates the exertion of force upon the same from someone in front of the device 10 and the closure 20. The steepest portion of the curve seen in FIG. 5, moreover, comprises the range roughly between 90° and 150° with the mean value of that range, 120°, being the inflection point of maximum rate of displacement.

In relation to a physical device constructed and installed in accordance with the principles relating to the present invention, the device is easiest to operate where it is most difficult to reach and apply force, when the frontal arm 13 is closest to the closure 20 and must be pulled outward. And the displacement through the portion of the first arm arc 26 between 90° and 150° from closed rapidly effects most of the total sash displacement 27 with the frontal bar 13 being pushed in extension of one's arms from the point where the frontal bar is closest, 90°. It is thus seen that the mechanical advantage, which varies inversely with the rate of linear sash displacement 27 as a function of the first arm arcuate travel 26 is complex and varies in a manner that optimizes the manual effort available for operation of a reciprocating sash 17 from a position in front of the closure 20.

Figure 2:
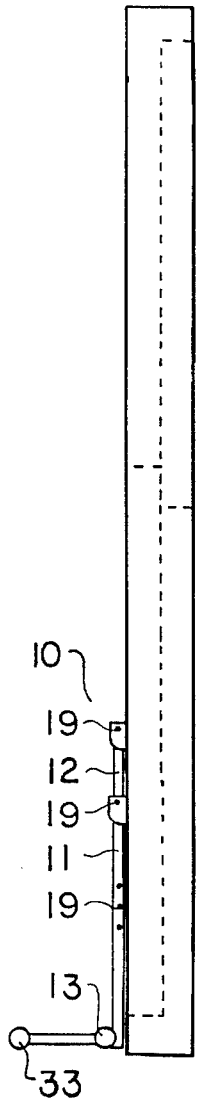
FIG. 2 is a plain elevational view taken from the side of an alternative embodiment of the principles relating to the present invention in the closed position illustrating an auxiliary frontal bar.

A device properly constructed and installed in accordance with the principles relating to the present invention further provides automatic locking of the sash 17 within the frame 28 when disposed in the closed position depicted in FIGS 1 & 2. This alleviates the operator of the need to reach to the top of the lower sash in the case of a double hung window and throw the lock or locks typically positioned thereon which, in the case wherein a barrier is disposed in front of and beneath the window, constitutes an action which is difficult for many people lacking either the upper body mobility, dexterity or the reach necessary to operate such locks so disposed.

It is also noted that many double sash hung windows possess pivoted connections slidable in the jambs which may be utilized to pivot the entire sash outward for ease in cleaning the exterior face of the window. If properly installed, a preferred embodiment of the principles relating to the present invention will not interfere with operation of this feature as each pair of linked congruent arms may be disposed such that all the arms are lateral to the face of the entire sash 17, as depicted in FIG. 1. The frontal bar 13 of this preferred embodiment is substantially parallel with the sill of the frame 28 in the closed position depicted in FIG I and it is readily seen that no obstruction to the front face of the entire sash 17 is made by the device 10.

Two basic options additional to the preferred embodiment of the principles relating to the present invention discussed above are considered. With reference to FIG. 2, an auxiliary frontal bar 33, parallel to and spaced apart from the frontal bar 13, connected by arms disposed perpendicular to the first arm 11, is depicted in side view. It is not necessary that the arms connecting this auxiliary frontal bar 33 to the linkage comprising the basic device 10 be perpendicular to the first arm 11, but this yields the greatest assistance in overcoming the reach over a barrier disposed in front of and beneath a reciprocating closure 20.

In regard to obtaining further mechanical advantage in the operation of a device 10 constructed in accordance with the principles relating to the present invention, an auxiliary arm 31 pivotally connected to a first arm 11 or the frontal bar 13 by means of a ratchet 29 as depicted in FIG. 4 is recommended. The additional mechanical advantage obtained is the additional length in leverage to the effective first arm length 21 which total is divided by the pivot arc radius 24 to yield the basic mechanical advantage derived from the device 10. The ratchet 29, should be oriented such that the pawls engage in the direction of increasing first arm arc 26 from the closed position and pivot freely in the opposite direction, in order to further facilitate reduced effort required in opening the closure 20.

Construction of a preferred embodiment of the principles relating to the present invention may be in any suitable material by any suitable means. However, hollow aluminum bars of hollow rectangular cross section are recommended for the arms and aluminum tube lateral elements 14 of the frontal bar 13 are recommended in conjunction with a wooden dowel comprising the medial element 15 and a slit thin wall length of plastic tubing comprising the sleeve 16 which, cut to length at the time of installation, provides an aesthetically pleasing cover for the telescoping lateral and medial elements and thus a range of closure widths is readily accommodated. The pivots 19 are standard hardware and the entire construction including installation is well within the abilities of one skilled in the art. It is further recommended, however, that attention be given to flush fitting of the connections, particularly with respect to the overall width of the device as many jambs are within very close proximity to a wall perpendicular to the face of the closure. To this end, countersinking of bolt heads and use of pop rivet style nuts is recommended for connection of aluminum hollow bar and tube stock. It is also suggested that construction and installation locate the frontal bar 13 in the closed position parallel to the sill in application upon a lower sash window as depicted in the figures attached.

Lastly, it is noted that while the present invention has been discussed with reference to figures depicting a double hung sash style window as the reciprocating closure 20 fully bounded within a frame 28 including two opposed jambs 18, this discussion readily applies to horizontally sliding windows, for instance, wherein the jambs are horizontal, the number of sashes easily exceeds two and the device 10 built in accordance with the principles relating to the present invention would be disposed such that the frontal bar 13 would be vertical instead of horizontal. The utility of such an embodiment in accordance with the principles relating to the present invention is readily grasped by one practiced in the art as are other applications.

The foregoing is intended to enable a thorough understanding of the principles relating to the present invention so that one practiced in the art may construct a device and use the same in accordance with said principles and is to be regarded in no manner as restrictive of either the rights and privileges granted or of the scope of the intellectual property secured by granting of Letters Patent for which I hereby claim:

I claim:

1. A device facilitating, from a frontal position linear displacement of one sash of a multi-sashed reciprocating closure possessing at least two reciprocating sashes held between two opposed jambs of a fully bounded frame, said device comprising:

a mechanical linkage consisting of a frontal bar rigidly connected to two congruent pair of pivotally connected first and second arms spaced apart from each other and disposed to rotate in planes substantially perpendicular to and proximate either end of said frontal bar;

each said first arm possessing connection to a pivot at a proximate end relative to the closure when properly installed and a rigid connection to said frontal bar at a distal end, each said second arm possessing a connection to a pivot on the proximate end relative to the closure when properly installed and a pivoted connection to said first arm at the distal end, this pivot between first and second arms further being located along said first arm medial to said proximate and distal ends of said first arm;

an effective second arm length is given by the distance between the pivot connecting said proximate second arm end and said pivot between arms, an effective first arm length is given by the distance between the pivot connected to said proximate first arm end and the connection to said frontal bar and a pivot arc radius is given by the distance between said first arm proximate end and said pivot between arms, each said effective arm length and said pivot arc radius being substantially equivalent between congruent pairs of arms;

each said pivot connected to said proximate first arm end further possessing the capability of being attached to one of said opposed pair of jambs, both said pivots connected to said proximate second arm end further possessing the capability of being attached to one said sash;

all said pivotal connections enabling rotation of all said arms within planes substantially parallel to one another and substantially perpendicular to both said frontal bar and the face of the closure when properly installed whereby the congruent effective distances and said pivotal connections enable movement of said frontal bar through an arc possessing a radius equal to said effective first arm length and movement of each said pivot between arms through a pivot arc possessing said pivot arc radius of a lesser dimension than said effective first arm length;

displacement of both said pivots between arms through said pivot arc thereby effecting linear displacement of said one sash through the transmission of force through both said second arms applied through both said pivots between arms exerted upon said frontal bar from a frontal position with respect to said reciprocating closure with a basic mechanical advantage given by said effective first arm length divided by said pivot arc radius and an overall mechanical advantage given by the inverse of the ratio of the rate of linear sash displacement as a function of arcuate frontal bar displacement.

2. The device of claim 1 wherein both said first arms and both said second arms are aligned with one another in the closed position of said reciprocating closure thereby providing a mechanical locking of said sash.

3. The device of claim 1 further including an auxiliary frontal bar rigidly disposed substantially parallel to and spaced apart from the primary frontal bar.

4. The device of claim 3 wherein said auxiliary frontal bar is further connected to said device by at least one rigid extension disposed substantially perpendicular to both said first arms.

5. The device of claim 1 wherein the position of each said pivot between arms along said first arm medial to said proximate and distal ends is adjustable.

6. The device of claim 5 wherein said position of each said pivot between arms is adjustable in discrete amounts equivalent between the congruent pairs.

7. The device of claim 1 further including an auxiliary first arm connected to said frontal bar extending substantially parallel to one said first arm a distance beyond the arc described by said effective first arm length.

8. The device of claim 7 wherein said connection of said auxiliary first arm to said frontal bar possesses a ratchet permitting rotation of said auxiliary arm about an axis collinear with that of said frontal bar in one direction and enables the transmission of force in the other direction.

9. The device of claim 8 wherein two said auxiliary first arms possessing connection to said frontal bar by a ratchet are further connected at the other end to an auxiliary frontal bar.

10. The device of claim 1 wherein the effective length of said frontal bar comprising the distance between both said rigid connections with each said distal first arm end is adjustable.

11. The device of claim 10 wherein said frontal bar is comprised of two lateral elements which are telescopic with respect to a medial element.

12. The device of claim 11 wherein each said lateral element is comprised of a rigid hollow extension possessing a substantially uniform interior cross section and said medial element comprises a rigid extension possessing a substantially uniform exterior perimeter suitably shaped and sized to fit into said uniform interior cross section of each said lateral member.

13. The device of claim 12 wherein both said frontal bar further includes a longitudinally slit thin walled tube possessing a substantially uniform interior suitably sized and shaped to fit about the exterior of each said lateral element.

14. The device of claim 13 wherein each said lateral element consists of a rigid cylinder, said medial element consists of a solid rod and said longitudinally slit thin walled tube consists of a cylinder.

15. The device of claim 1 wherein said reciprocating closure consists of a double hung sash type window wherein said jambs are vertically disposed.

16. The device of claim 15 wherein said pivotal connections of both said second arms are made to the lower sash of said double hung sash window in proper installation.

17. The device of claim 16 wherein said frontal bar is disposed in the closed position immediately adjacent to and parallel with the bottom sill of said window.

18. The device of claim 17 wherein each said pair of arms, when properly installed, are located laterally with respect to the entire front face of said sash which, if possessing hinged attachment to said two opposed jambs, may be tilted outward for cleaning without interference from said device.

* * * * *